United States Patent [19]

Nakayama

[11] 4,036,192

[45] July 19, 1977

[54] ENGINE FUEL INJECTION SYSTEM

[75] Inventor: Kenji Nakayama, Higashi Matsuyama, Japan

[73] Assignee: Diesel Kiki Co., Tokyo, Japan

[21] Appl. No.: 548,101

[22] Filed: Feb. 7, 1975

[30] Foreign Application Priority Data

| | | |
|---|---|---|
| Feb. 8, 1974 | Japan | 49-15408 |
| Aug. 20, 1974 | Japan | 49-94644 |

[51] Int. Cl.[2] ..... F02M 47/02

[52] U.S. Cl. ..... 123/139 AT; 123/139 DP

[58] Field of Search ..... 123/139 AT, 139 AK, 123/139 AF, 139 AS, 139 BF, 139 DP

[56] References Cited

U.S. PATENT DOCUMENTS

| | | | |
|---|---|---|---|
| 2,173,811 | 9/1939 | Bischof | 123/139 AT |
| 2,173,812 | 9/1939 | Bischof | 123/32 G X |
| 3,505,984 | 4/1970 | Mansfield | 123/139 AT |
| 3,625,192 | 12/1971 | Dreisin | 123/139 AT X |
| 3,810,453 | 5/1974 | Wolfe | 123/139 AT X |

FOREIGN PATENT DOCUMENTS

| | | | |
|---|---|---|---|
| 508,945 | 6/1939 | United Kingdom | 123/139 AT |

*Primary Examiner*—Carroll B. Dority, Jr.

*Assistant Examiner*—Tony M. Argenbright

*Attorney, Agent, or Firm*—Edward F. Connors

[57] ABSTRACT

A plunger slidable in a barrel of a plunger pump is actuated by an engine driven camshaft to feed high pressure fuel through a delivery valve to an injection nozzle. A needle type valve element extends through a nozzle chamber in the nozzle connected to the pump to control fuel flow from the nozzle chamber through an injection orifice into the engine. The needle end of the valve element is exposed to pressurized fuel in the nozzle chamber, and a spring applies a force to the other end of the valve element to urge the valve element to block the injection orifice. As the pump plunger moves through its injection stroke, the pressure in the nozzle chamber increases and overcomes the force of the spring to move the valve element to unblock the orifice to initiate fuel injection. Near the end of the plunger stroke, the plunger uncovers a hole in the barrel so that pressurized fuel is fed through passageways in the plunger, the hole and a check valve to a surface of the valve element to apply a force to the valve element in the same direction as the spring force to move the valve element to block the orifice and terminate fuel injection without valve element rebound or fuel dribbling.

13 Claims, 6 Drawing Figures

ENGINE FUEL INJECTION SYSTEM

The present invention relates to an improved engine fuel injection system in which dribbling of fuel from a fuel injection nozzle after fuel injection is prevented.

In a Bosch type Diesel engine fuel injection system which is well known in the prior art, a plunger pump actuated by an engine driven camshaft feeds fuel under high pressure to a fuel injection nozzle for injection into the engine. The pump includes a plunger slidably movable in a barrel through an injection stroke by the camshaft. The barrel has a fuel inlet port connected to a low pressure fuel source which is covered during the early stage of the plunger movement so that fuel trapped in the barrel is forced outward at high pressure through a delivery valve to a nozzle chamber in the injection nozzle. An orifice leads from the nozzle chamber into the engine cylinder, and fuel flow from the nozzle chamber through the orifice is controlled by a needle valve element biased by a spring to block the orifice. The needle end of the valve element is exposed to fuel pressure in the nozzle chamber so that when the pressure in the nozzle chamber overcomes the force of the spring during the plunger stroke, the valve element is moved to unblock the orifice and allow fuel injection. At the end of the plunger stroke, a groove in the plunger uncovers the fuel inlet port so that high pressure fuel trapped in the barrel may escape through the fuel inlet port to the fuel source. The resulting pressure drop in the nozzle chamber allows the spring to move the valve element to block the orifice and terminate fuel injection.

Although this fuel injection system is quite operable and widely employed in practical applications, it suffers from a major drawback in that fuel injection is not perfectly terminated in a desired rapid manner when the fuel inlet port is uncovered by the plunger groove. Specifically, movement of the valve element may not be rapid as desired resulting in an overly long fuel injection period. Also, the valve element tends to rebound after seating to block the orifice, resulting in secondary injection or fuel dribbling. Such dribbling is highly undesirable since it degrades the performance of the engine and causes incomplete combustion of valuable fuel resulting in waste and atmospheric pollution.

In a fuel injection system of this type, as opposed to a unit injection system, due to the operation of the delivery valve, even after the fuel inlet port is uncovered by the plunger groove, the residual pressure in the nozzle chamber and the fuel line leading thereto from the delivery valve is high. Thus, the difference between the spring force acting on the valve element to move the valve element to block the orifice to terminate fuel injection and the force developed by the pressurized fuel in the nozzle chamber opposing the spring force is not as high as desired, and the termation of fuel injection requires an excessive amount of time. A prior art method of increasing the speed of movement of the valve element to terminate fuel injection is embodied in a specially designed delivery valve. Such a valve is shown in FIG. 5 of the drawings and will be described in detail below. This valve, after blocking fuel flow therethrough, acts to increase the volume of the fuel line between the valve and the nozzle chamber thereby rapidly decreasing the fuel pressure in the nozzle chamber. Although a delivery valve of this type provides more rapid movement of the valve element to terminate fuel injection by providing a greater force differential on the valve element, the valve element tends to rebound from its seat resulting in dribbling. A shock wave created by the rapid pressure drop may also cause the valve element to unblock the orifice for a brief period after normal fuel injection has terminated.

Further prior art attempts to eliminate these problems involve increasing the output pressure of the plunger pump and the stiffness of the valve element spring to reduce the fuel injection duration. However, these attempts have led to more problems in the design of the plunger pump, injection nozzle and piping to withstand such high pressure. Also, the nozzle orifice would be required to be larger in area, creating problems in fuel atomization and dispersion.

It is therefore an object of the present invention to provide a fuel injection system, especially suited to a Diesel engine, which overcomes the above described drawbacks of prior art fuel injection systems.

It is a further object of the present invention to provide an improved fuel injection system operating at substantially the same pressures as conventional comparable fuel injection systems by which rapid termination of fuel injection without fuel dribble is produced.

It is a further object of the present invention to provide a fuel injection system comprising a plunger pump supplying fuel through an injection nozzle to an engine, the injection nozzle having a valve element controlling fuel injection into the engine, in which high pressure fuel from the plunger pump is applied to the valve element to terminate fuel injection near the end of the injection stroke of the pump plunger.

The above and other objects, features and advantages of the present invention will become more clear from the following detailed description taken with the accompanying drawings, in which.

Figure 1:
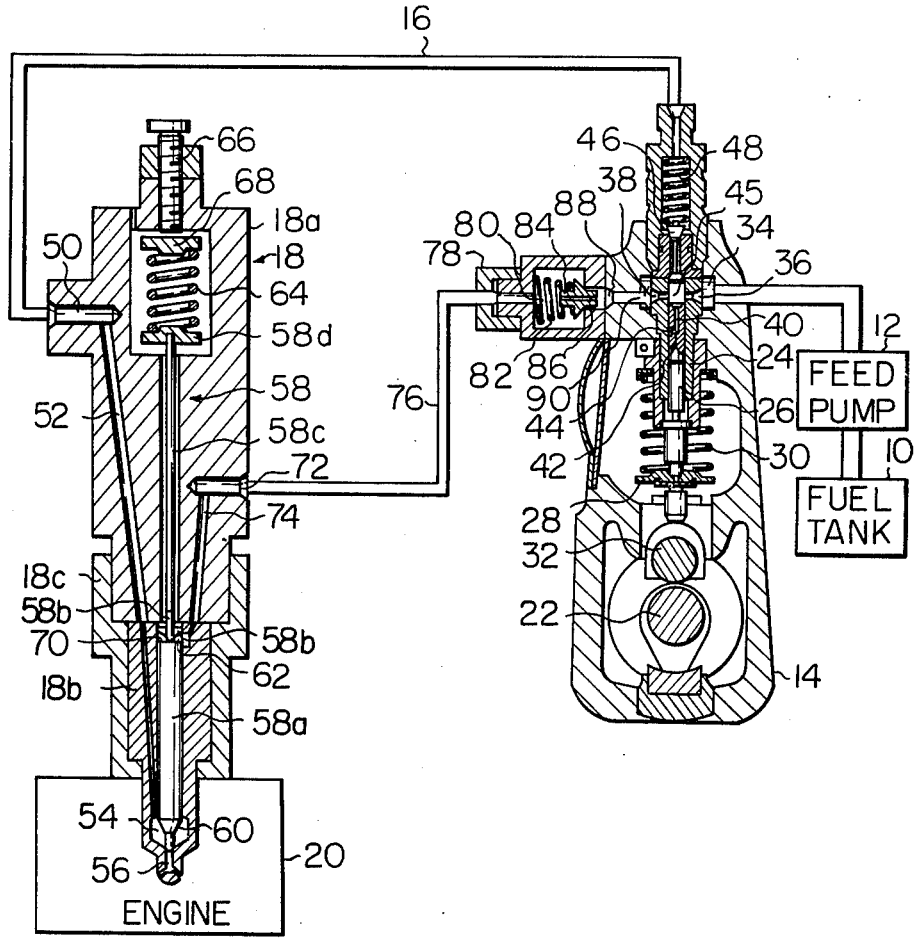
FIG. 1 is a schematic sectional view of a fuel injection system embodying the present invention.
Figure 2:
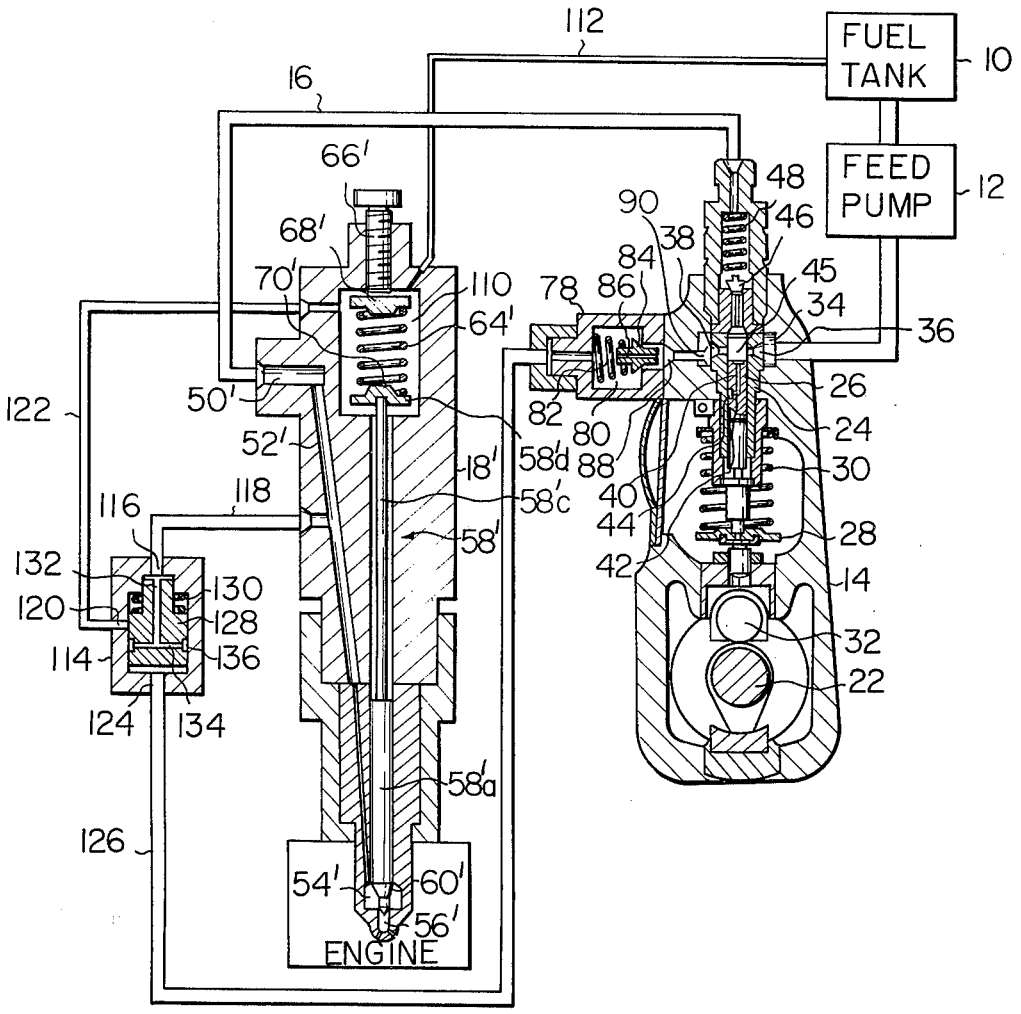
FIG. 2 is a schematic sectional view of another fuel injection system embodying the present invention.
Figure 4A:
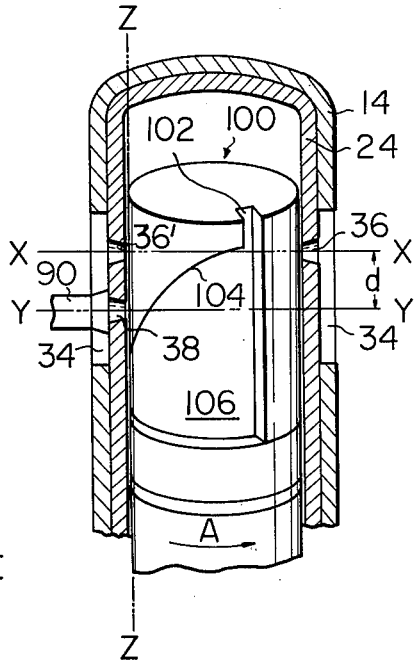
Figure 4B:
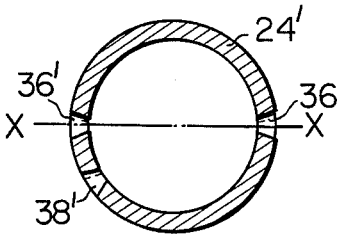
Figure 5:
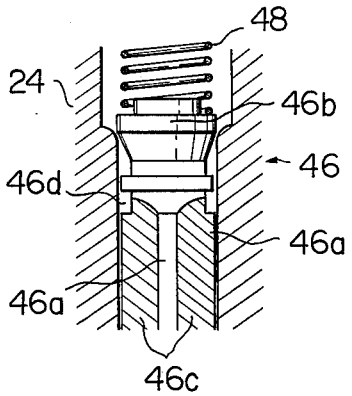

FIG. 4*a* is a fragmentary perspective cutaway view of a barrel and plunger of a plunger pump of the fuel injection systems shown in FIGS. 1 and 2;

FIG. 4*b* is a sectional view of the barrel shown in FIG. 4*a* taken in a plane perpendicular to the axis of the barrel and containing a line X—X shown in FIG. 4*a;* and FIG. 5 is a longitudinal sectional view of a delivery valve of the fuel injection systems shown in FIGS. 1 and 2.

Referring now to FIG. 1, a fuel injection system embodying the present invention comprises a fuel tank 10 containing, for example, a liquid fuel such as Diesel oil. A low pressure supply or feed pump 12 pumps fuel from the tank 10 to a high pressure plunger pump 14, which in turn feeds the fuel at high pressure through a fuel delivery line 16 to a fuel injection nozzle 18. The nozzle 18 is connected to inject fuel into a cylinder of an engine such as a Diesel engine generally designated as 20.

The plunger pump 14 comprises a camshaft 22 driven by the engine 20 in a synchronized relationship with the operation of the engine 20. A plunger barrel 24 is fixedly mounted in the pump 14, and a plunger 26 is sealingly slidable in the barrel 24. A spring plate 28 is fixed to the lower end of the plunger 26 as shown, by which the plunger 26 is biased downward by a compression spring 30 into contact with a roller tappet 32 actuated by the camshaft 22. The pump 14 is formed with an annular suction chamber 34, into which fuel is fed from the feed pump 12. The barrel 24 extends through the suction chamber 34 and has two holes formed through the circumference thereof and opening into the suction chamber 34; a fuel inlet port or hole 36 and another hole 38. The hole 38 is positioned closer to the camshaft 22 than the hole 36 in the example shown.

The plunger 26 is formed with a longitudinal passageway 40 leading from its upper end as shown in FIG. 1 to a radial passageway 42. The radial passageway 42 opens into an annular groove 44 formed in the circumference of the plunger 26. A delivery or check valve 46 is urged by a compression spring 48 to seat on the top of the barrel 24, and a pressure chamber 45 is defined within the barrel 24 by the end of the plunger 26 and the delivery valve 46. The line 16 leads from a chamber (no numeral) housing the spring 48 to an inlet 50 of the nozzle 18. A pressure passageway 52 of the nozzle 18 leads to a nozzle chamber 54, and an orifice 56 leads from the nozzle chamber 54 into the engine 20 cylinder.

The nozzle 18 comprises a main body 18*a,* a nozzle body 18*b* and a retaining nut 18*c* by which the nozzle body 18*b* is connected to the main body 18*a.* The nozzle chamber 54 and orifice 56 are formed in the nozzle body 18*b,* and the pressure passageway 52 extends through both the main body 18*a* and nozzle body 18*b.* A valve element generally designated as 58 comprises a nozzle needle 58*a* sealingly slidable in a longitudinal bore (no numeral) of the nozzle body 18*b.* The bottom end of the needle 58*a* is adapted to sealingly seat on the opening of the orifice 56 to block fuel flow through the orifice 56 from the nozzle chamber 54. A first pressure surface 60 of the needle 58*a* is exposed to pressurized fuel in the nozzle chamber 54.

The valve element 58 further comprises a spacer 58*b* having an upper stem sealingly slidable in a longitudinal bore (no numeral) formed in the main body 18*a* and a tapered or conical lower portion (not designated). The lower end of the tapered portion of the spacer 58*b* abuts against the top of the needle 58*a* in the condition shown in FIG. 1, and the diameter of the upper end of the tapered portion of the spacer 58*b* is larger than the diameter of the stem portion. A chamber 62 is defined within the bore of the nozzle body 18*b* between the top of the needle 58*a* and the bottom tapered surface of the spacer 58*b.* A pressure spindle 58*c* of the valve element 58 is slidable in the bore of the main body 18*a,* has fixed to its upper end a spring plate 58*d* and abuts at its lower end with the upper end of the spacer 58*b.* An adjusting bolt 66 is adjustably longitudinally screwed through the top of the main body 18*a,* and has fixed to its bottom end a spring plate 68. A compression spring 64 is compressed between the spring plates 68 and 58*d* to urge the valve element 58 downward to block the orifice 56. The opening pressure of the valve element 58 may be adjusted by means of the bolt 66. The upper end of the needle 58*a* is designated as a second pressure surface 70, and the effective area of the pressure surface 70 is preferably greater than the effective area of the pressure surface 60. By effective area is meant the area upon which fluid pressure applied to the first or second surface 60 or 70 will result in a longitudinal force being applied to the needle 58*a.*

The main body 18*a* is formed with another fuel inlet 72 which communicates through a passageway 74 with the chamber 62. A fuel line 76 connects the inlet 72 with a check valve generally designated as 78. A chamber 80 is formed within the check valve 78 in which is received a compression spring 82 which urges a valve element 84 to seat against the right wall (no numeral) of the chamber 80 to block a passageway 88 opening into the suction chamber 34. The fuel line 76 opens directly into the chamber 80. The valve element 84 is formed with a longitudinal constricted passageway 86. A pipe 90 is tightly fitted in the passageway 88 and has a flared right end which is disposed closely adjacent to the opening of the hole 38 and surrounds the hole 38 so that a small clearance is defined between the pipe 90 and the barrel 24. Depending on design requirements, the pipe 90 may be directly connected to the barrel 24 to form a direct connection between the pipe 90 and hole 38 and eliminate communication between the hole 38 and the suction chamber 34.

The delivery valve 46 represents the delivery valve mentioned above with respect to the prior art to increase the speed of termination of fuel injection. The delivery valve 46 may be utilized in a fuel injection system according to the present invention shown in FIG. 1, or the delivery valve 46 may be replaced by an ordinary check valve as desired. The delivery valve 46 is shown in FIG. 5 as an integral unit having a valve stem 46*a* sealingly slidable in the barrel 24 and a valve head 46*b* adapted to abut against the top of the barrel 24. The valve stem 46*a* is formed with passageways or cutouts 46*c* to define a chamber 46*d* within the barrel 24 below the upper portion of the valve stem 46*a.* The chamber 46*d* therefore communicates with the pressure chamber 45 through the cutouts 46*c.*

The operation of the fuel injection system of FIG. 1 begins with all components in the positions shown in FIG. 1. The top of the plunger 26 is below the hole 38 so that the pressure chamber 45 within the barrel 24 is connected to the suction chamber 34 through the holes 36 and 38 and filled with fuel at the feed pump 12 pressure. The chamber 62 of the nozzle 18 is also connected to the suction chamber 34 through the passageway 74, line 76, chamber 80 and passageway 86 of the check valve 78 and filled with fuel at feed pump 12 pressure. The valves 46 and 78 are closed and the needle 58*a* blocks the orifice 56. The line 16, passageway 52 and chamber 54 are filled with fuel at a pressure higher than the feed pump 12 pressure but lower than the pressure required to move the needle 58*a.*

As the lobe of the cam (no numeral) of the camshaft 22 is rotated by the engine 20 to contact the roller tappet 32, the tappet 32 and plunger 26 start to move upward as viewed in FIG. 1 in an injection stroke. The top of the plunger 26 passes over the hole 38 so that the circumference of the plunger 26 blocks the hole 38. Upon further upward movement of the plunger 26, the top of the plunger 26 passes over the top of the hole 36 to block the hole 36. At this point, communication between the pressure chamber 45 and the suction chamber 34 is blocked, and further movement of the plunger 26 causes the fuel to be compressed in the pressure chamber 45. As the force exerted by the fuel in the pressure chamber 45 on the delivery valve 46 exceeds the force of the spring 48, the delivery valve 46 moves upward compressing the fuel in the line 16, passageway 52 and chamber 54. When the upper portion of the chamber 46*d* defined by the delivery valve 46 and barrel 24 aligns with the top of the barrel 24, communication is established between the pressure chamber 45 and the line 16 through the cutouts 46*c* and chamber 46*d.* Fuel is then forced by the plunger 26 from the pressure chamber 45 into the line 16 and chamber 54 of the nozzle 18. When the pressure in the chamber 54 is sufficient to overcome the force of the spring 64, the pressurized fuel in the chamber 54 acting on the first surface 60 of the needle 58*a* forces the valve element 58 upward until the top of the conical portion of the spacer 58*b* abuts against the bottom of the main body 18*a,* thus opening the orifice 56 and injecting fuel into the engine from the chamber 54.

Fuel injection continues until the annular groove 44 of the plunger 26 aligns with the hole 38 in the barrel 24 establishing communication between the pressure chamber 45, the suction chamber 34 and the pipe 90 through the longitudinal passageway 40, radial passageway 42, annular groove 44 and hole 38. Although some fuel escapes from the pressure chamber 45 to the suction chamber 34 through the clearance between the barrel 24 and the pipe 90, a larger amount of fuel is directed from the hole 38 into the pipe 90 and passageway 88 due to the inertia of the pressurized fuel and the flared configuration of the opening of the pipe 30. This fuel forces open the valve element 84 against the force of the spring 82 so that pressurized fuel from the pressure chamber 45 is fed to the chamber 62 of the nozzle 18 through the chamber 80 of the check valve 78, the line 76 and the passageway 74. This high pressure fuel in the chamber 62 holds the spacer 58*b* in engagement with the bottom of the main body 18*a* and acts on the surface 70 of the needle 58*a* to rapidly drive the needle 58*a* downward to block the orifice 56 and terminate fuel injection.

The plunger 26 is arranged to reach the end of its injection stroke as the groove 44 aligns with the hole 36 thereby establishing communication between the pressure chamber 45 and the suction chamber 34 through the longitudinal passageway 40, the radial passageway 42, the annular groove 34 and the hole 36. At this point, fuel is discharged from the pressure chamber 45 into the suction chamber 34 rapidly through the hole 36, and the pressure in the pressure chamber 45 drops to a level at which the force of the spring 48 is stronger than the force of the pressurized fuel in the pressure chamber 45 acting on the delivery valve 46. The valve 46 is moved downward by the spring 48 until the top of the chamber 46*d* drops below the top of the barrel 24, thereby blocking communication between the pressure chamber 45 and the line 16. The spring 48 moves the valve 46 further downward until the valve head 46*b* abuts against the top of the barrel 24, thereby rapidly increasing the volume of the enclosure including the chamber housing the spring 48, the line 16, the inlet 50, the passageway 52 and the chamber 54 causing a rapid drop in pressure therein as described above with reference to the prior art.

After the injection stroke of the plunger 26 is terminated, the lobe of the cam of the camshaft 22 moves out of contact with the roller tappet 32 and the plunger 26 is moved downward by the spring 30 to the position shown in FIG. 1 so that the holes 36 and 38 are uncovered by the plunger 26 and the pressure chamber 45 becomes filled with fuel at the feed pump 12 pressure in preparation for another injection stroke. The pressure drop in the pressure chamber 45 and leakage from the pipe 90 into the suction chamber 34 through the clearance between the barrel 24 and the pipe 90 causes the spring 82 to move the valve element 84 to block the passageway 88. Fuel thereafter flows from the chamber 80 into the suction chamber 34 through the constricted passageway 86 and passageway 88 until the pressure in the chamber 80 and thereby in the chamber 62 reaches the feed pump 12 pressure, allowing the spring 64 to move the spring plate 58*d,* the spindle 58*c* and the spacer 58*b* downward until the bottom of the spacer 58*b* abuts against the top of the needle 58*a* to hold the needle 58*a* in the position shown in FIG. 1 blocking the orifice 56. It will be noted that rather than the passageway 86, a separate constricted passageway may be provided bypassing the valve element 84, although not shown.

The various elements of the fuel injection system may be modified according to the design requirements within the scope of the invention. For example, the arrangement may be such that when the hole 38 is uncovered by the annular groove 44 of the plunger 26 thereby connecting the pressure chamber 45 to the chamber 62 of the nozzle 18, the combination of the force developed by the fuel in the chamber 62 and the force of the spring 64 in insufficient to overcome the force developed by the fuel in the chamber 54 acting on the valve element 58. In this case, the valve element 58 will be moved to block the orifice 56 and terminate fuel injection when the annular groove 44 uncovers the hole 36 thereby decreasing the pressure in the chamber 54 to a point where the spring 64 and fuel pressure in the chamber 62 overcome the force exerted by the fuel in the chamber 54 on the valve element 58 to move the valve element 58 and terminate fuel injection. In either case, it will be realized that the objects of the present invention are accomplished since the force developed by the pressurized fuel in the chamber 62 acts in combination with the force of the spring 64 to move the valve element 58 to terminate fuel injection at a speed unattainable in prior art systems, and that the pressurized fuel in the chamber 62 further increases the force on the valve element 58 to hold the valve element 58 in position to block the orifice 56 immediately after termination of fuel injection to prevent rebound of the valve element 58 and fuel dribbling. These objects are accomplished without increasing the output fuel pressure of the plunger pump 14.

One skilled in the art will recognize that the specific configuration of the plunger 26 and barrel 24 shown in FIg. 1 is especially suited to a single speed Diesel engine, since means are not shown for changing the engine speed by varying the amount of fuel introduced into the engine. The scope of the present invention, however, includes applications involving variable speed engines, examples being illustrated in FIGS. 4*a* and 4*b.*

Referring now to FIG. 4*a,* the barrel 24 is slightly modified in that it is formed with an additional hole through the circumference thereof designated as 36'. The hole 36' is radially opposed to the hole 36 on a line X—X. The hole 38 is as shown and described with reference to FIG. 1, and lies on a line Y—Y which is longitudinally spaced from the line X—X by a distance *d.* The plunger 26 has been replaced by a plunger 100 which is sealingly slidable in the barrel 24, similar to the plunger 26. The configuration of the plunger 100 is well known in the art, and includes a longitudinal groove 102 communicating at one end with the pressure chamber 45 and at the other end with a circumferential chamber 106 produced by milling or otherwise cutting the circumference of the plunger 100. The upper portion of the chamber 106 is defined by a helix 104. The plunger 100 is longitudinally movable by the camshaft 22 and rotatable by the engine operator by means of a toothed control sleeve integral with the plunger 100, a control rack meshing with the teeth of the sleeve and an appropriate linkage which are well known in the art but not shown. In the example shown in FIG. 4*a*, the hole 36 is optional.

The operation of the plunger assembly shown in FIG. 4*a* is identical to that of the system shown in FIG. 1 except for the variable speed feature which will now be described. The engine speed is controlled by rotating the plunger 100 to vary the effective length of the plunger 100 stroke, or the distance moved by the plunger 100 when it is actually compressing fuel in the pressure chamber 45. Assuming the case in which fuel injection terminates when the pressure chamber 45 is connected to the suction chamber 34 at the end of the plunger stroke, it will be understood that this connection is accomplished through the longitudinal groove 102, the chamber 106 and the hole 36' when the bottom of the helix 104 uncovers the hole 36'. The effective stroke of the plunger 100 is the distance between the top of the plunger 100 and the bottom of the helix 104 along a line Z—Z on the circumference of the plunger 100 defined by the intersection of the circumference of the plunger 100 with a plane containing the lines X—X and Y—Y. Rotation of the plunger 100 in the direction indicated by an arrow A therefore increases the effective stroke of the plunger 100 and the amount of fuel injected into the engine 20. Since the hole 38 is formed at the line Z—Z and lies below the hole 36' as viewed in FIG. 4*a*, the hole 38 will be uncovered before the hole 36' to obtain results identical to those produced by the plunger 26 shown in FIG. 1.

An additional modification of the barrel 24 is shown in FIG. 4*b*, which is a section of a barrel 24' similar to the barrel 24 and viewed from the top as shown in FIG. 4*a*. In this example, the holes 36 and 36' are formed on the line X—X as with the barrel 24 shown in FIG. 4*a*. A hole 38', performing the same function as the hole 38, is formed through the barrel 24' at the same longitudinal position as the line X—X but circumferentially spaced therefrom in the counterclockwise direction as viewed in FIG. 4*b*. Reference to both FIGS. 4*a* and 4*b* will show that as the plunger 100 is moved longitudinally during its injection stroke by the camshaft 22, the hole 38' will be uncovered before the hole 36' by the bottom of the helix 104 due to the configuration of the helix 104 and the relative locations of the holes 36' and 38'. Thus, the same results are produced as with the system shown in FIG. 1.

Another embodiment of a fuel injection system according to the present invention is shown in FIG. 2. The fuel tank 10, feed pump 12 and plunger pump 14 are identical to those shown in FIG. 1. A fuel injection nozzle 18' is a modified version of the nozzle 18 shown in FIG. 1, and corresponding parts are indicated by the same reference numerals followed by an apostrophe. It will be noted that the spacer 58*b*, inlet 72, passageway 74 and chamber 62 are omitted, and that the bottom end of the spindle 58'*c* bears directly on the top of the needle 58'*a*. A spring chamber enclosing the spring 64' is designated as 110, and is connected to the low pressure side of the fuel tank 10 by a constricted passageway 112. A valve 114 is provided with an inlet 116 connected to the present passageway 52' of the nozzle 18' by a fuel line 118. An outlet 120 of the valve 114 is connected to the spring chamber 110 of the nozzle 18' by a fuel line 122. A control inlet 124 of the valve 114 is connected to the chamber 80 of the check valve 78 by a fuel line 126. The valve 114 further includes a valve element 128 which is sealingly slidable within the bore (no numeral) of the valve 114 and is urged toward the control inlet 124 by a compression spring 130. The valve element 128 is formed with a longitudinal passageway 132 open at one end to the inlet 116 and at the other end to a radial passageway 134 which in turn opens into an annular groove 136 formed in the circumference of the valve element 128.

The operation of the embodiment of FIG. 2 is identical to that of FIG. 1 except for details which will be described below.

The valve element 128 is normally in the position shown in FIG. 2 blocking communication between the inlet 116 and outlet 120. Fuel injection is performed as described with reference to FIG. 1 until the annular groove 44 of the plunger 26 uncovers the hole 38 of the barrel 24 and the check valve 78 is opened and pressurized fuel is fed from the pressure chamber 45 into the chamber 80 of the check valve 78. This fuel is fed through the line 126 to the control inlet 124 of the valve 114 and moves the valve element 128 upward is viewed in FIG. 2 against the force of the spring 130. When the annular groove 136 aligns with the outlet 120, the pressure passageway 52' is connected to the spring chamber 110 through the line 118, inlet 116, longitudinal passageway 132, radial passageway 134, annular groove 136, outlet 120 and line 122. This high pressure fuel is applied to the top of the valve element 58' which defines a second surface 70' having an area equal to the cross section of the spindle 58'*c*. Pressurized fuel applied to the second surface 70', in combination with the force of the spring 64', urges the valve element 58' to rapidly block the orifice 56' to terminate fuel injection. Fuel flow from the pressure passageway 52' to the spring chamber 110 also causes a rapid and substantial reduction of the fuel pressure in the pressure passageway 52' and chamber 54' which facilitates rapid movement of the valve element 58'. The pressurized fuel in the spring chamber 110 is returned to the fuel tank 10 after a suitable time period through the constricted passageway 112, and the valve 114 is closed when the fuel pressure in the chamber 80 is overcome by the force of the spring 130.

Connection of the pressure passageway 52' with the spring chamber 110 may be accomplished before or at the same time the hole 36 is uncovered by the annular groove 44 of the plunger 26 by incorporating a delay function well known in the art into the valve 114. If desired, a plunger as shown in FIG. 4*a* or 4*b* may be utilized with the embodiment of FIG. 2.

Figure 3:
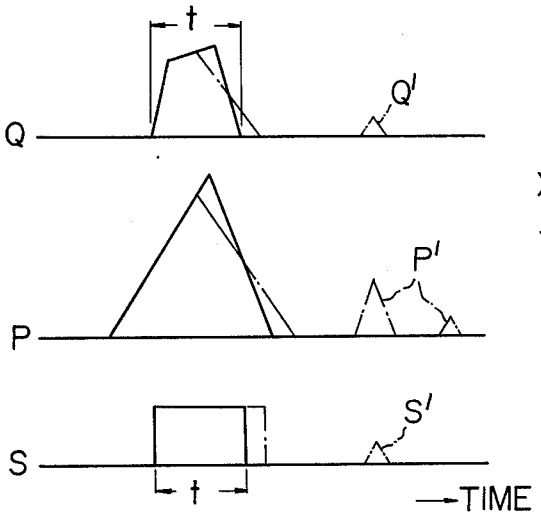
FIG. 3 is a graphic illustration of the operation of the fuel injection systems shown in FIGS. 1 and 2.

FIG. 3 graphically illustrates the improved performance of a fuel injection system according to the present invention as compared with a prior art fuel injection system. The fuel injection flow rate Q through the orifice 56 or 56', the pressure P in the delivery line 16 and the displacement S of the needle 58*a* or 58*a'* are shown as functions of time in solid line for a fuel injection system of the present invention and in broken line for a typical prior art fuel injection system. In particular, it will be noted that with the system of the invention, the fuel injection period may be limited to a precise short duration *t*, whereas with the prior art system the fuel injection duration is prolonged due to insufficiently rapid movement of the needle valve element to block the nozzle orifice. In addition, rebound of the needle valve element or a shock wave in the delivery line caused by closing of the delivery valve in the prior art system causes secondary opening of the nozzle orifice designated as S' which causes dribbling or secondary injection Q' and pressure oscillations P' in the delivery line. These effects are completely eliminated in the fuel injection system of the present invention.

It will be noted that many modifications may be made to the fuel injection systems shown by those skilled in the art to meet various design requirements, and that the present invention may be applied to any fuel injection system whereby high pressure fuel from a plunger pump pressure chamber is utilized in combination with the force of a spring to move a valve element of a fuel injection nozzle to terminate fuel injection.

What is claimed is:

1. A fuel injection system for an engine comprising, in combination:

a fuel source;

a plunger pump adapted to be driven by the engine and having a barrel in which a plunger is sealingly slidable, the barrel and plunger defining a pressure chamber, the barrel being formed with a first and a second hole through the circumference thereof, the plunger being formed with a longitudinal passageway opening at one end into the pressure chamber and a circumferential groove connected to the other end of the longitudinal passageway, the first hole being connected to the fuel source;

a fuel injection nozzle adapted to be operatively connected to the engine and connected to the pressure chamber, the plunger pump being connected to supply fuel from the fuel source to the nozzle at high pressure, the nozzle having a valve element biased to block fuel flow through the nozzle, the valve element having a first surface exposed to pressurized fuel from the pump so that the valve element is urged by the pressurized fuel applied to the first surface in a direction opposite to the biasing force so that the force of the pressurized fuel on the first surface overcomes the biasing force during the injection stroke of the pump plunger to move the valve element to allow fuel flow through the nozzle and thereby fuel injection into the engine, the valve element having a second surface connected to the second hole and arranged so that the pressurized fuel from the pump applied to the second surface urges the valve element in the same direction as the biasing force; and, a valve connected to feed pressurized fuel from the pump to the second surface of the valve element near the end of the injection stroke of the plunger whereby the biasing force and the force of the pressurized fuel applied to the second surface of the valve element in combination move the valve element against the force of the pressurized fuel applied to the first surface of the valve element to move the valve element to block fuel flow through the nozzle and terminate the fuel injection, said valve including the plunger and the barrel formed with the second hole, the first and second holes being arranged so that in sequence during the injection stroke of the plunger, the second hole is covered by the end of the plunger defining the pressure chamber thereby blocking communication between the pressure chamber and the second surface of the valve element, the first hole is covered by the end of the plunger defining the pressure chamber thereby blocking communication between the pressure chamber and the fuel source, the second hole is uncovered by the circumferential groove of the plunger thereby allowing communication between the pressure chamber and the second surface for the valve element and the first hole is uncovered by the circumferential groove of the plunger thereby allowing communication between the pressure chamber and the fuel source, said valve further including a check valve unit connected between the second hole of the barrel and the second surface of the valve element of the nozzle to permit fuel flow only from the second hole to the second surface, said check valve unit comprising a chamber formed therewithin, a passageway connected between the chamber and the second hole of the barrel, and a valve element urged by a compression spring disposed in the chamber to block the passageway and formed with a longitudinal constricted passageway to bypass the passageway.

2. The fuel injection system of claim 1, further comprising a check valve connected between the pressure chamber of the plunger pump and the injection nozzle to permit fuel flow only from the pressure chamber to the nozzle.

3. The fuel injection system of claim 1, in which the injection nozzle includes a spring to apply the biasing force to one end of the valve element to bias the valve element to block fuel flow through the nozzle.

4. The fuel injection system of claim 3, in which the second surface of the valve element is the end to which the force of the spring is applied.

5. The fuel injection system of claim 4, in which the nozzle defines a spring chamber in which the spring is disposed.

6. The fuel injection system of claim 5, further comprising a constricted passageway connecting the spring chamber to the fuel source.

7. The fuel injection system of claim 5, in which the injection nozzle is formed with a chamber connected to receive pressurized fuel from the pump, the chamber being formed with an injection orifice operatively opening into the engine, the other end of the valve element being arranged to control fuel flow from the chamber through the orifice and the first surface of the valve element being exposed to pressurized fuel in the chamber.

8. The fuel injection system of claim 7, in which said valve further includes a valve unit having an inlet connected to the chamber of the nozzle, an outlet connected to the spring chamber and a control inlet connected to the second hole of the barrel, the valve unit being arranged to normally block communication between the inlet and outlet and to allow communication between the inlet and outlet when the second hole of the barrel is uncovered by the circumferential groove of the plunger and the pressure chamber is thereby connected to the control inlet through the second hole.

9. The fuel injection system of claim 1, in which the circumferential groove of the plunger is in the form of a helix.

10. The fuel injection system of claim 1, in which the first and second holes of the barrel are circumferentially spaced from each other.

11. The fuel injection system of claim 1, in which the first and second holes of the barrel are longitudinally spaced from each other.

12. The fuel injection system of claim 1, in which the plunger pump further defines a suction chamber connected to the fuel source, the barrel extending through the suction chamber with the first and second holes open to the suction chamber, the system further comprising a fuel line connecting the suction chamber to the second surface of the valve element, the end of the fuel line connected to the suction chamber being closely adjacent to and surrounding the second hole of the barrel where the second hole opens into the suction chamber.

13. The fuel injection system of claim 1, in which the effective area of the second surface of the valve element is greater than the effective area of the first surface of the valve element.

* * * * *